US006142911A

United States Patent [19]

Sauvignet et al.

[11] Patent Number: 6,142,911

[45] Date of Patent: Nov. 7, 2000

[54] METHOD FOR TRAINING AND FOR MEASURING PHYSICAL EFFORTS OF A PERSON IN A NON-MOTORIZED WHEEL VEHICLE

[75] Inventors: Bernard Sauvignet, Roche la Moliere; Paul Calmels, Le Bessat, both of France

[73] Assignee: Centre Stephanois de Recherches Mechaniques Hydromecanique et Frottement S.A., France

[21] Appl. No.: 09/202,158

[22] PCT Filed: Nov. 24, 1997

[86] PCT No.: PCT/FR97/02120

§ 371 Date: Dec. 9, 1998

§ 102(e) Date: Dec. 9, 1998

[87] PCT Pub. No.: WO98/23332

PCT Pub. Date: Jun. 4, 1998

[30] Foreign Application Priority Data

Nov. 25, 1996 [FR] France ..... 96 14727

[51] Int. Cl.[7] ..... A63B 21/00

[52] U.S. Cl. ..... 482/6; 482/4; 482/900

[58] Field of Search ..... 482/1–9, 51–54, 482/57–59, 63–66, 71, 72, 900, 901

[56] References Cited

U.S. PATENT DOCUMENTS

| | | | |
|---|---|---|---|
| 3,940,989 | 3/1976 | Engerstam | 482/4 |
| 4,625,551 | 12/1986 | Carnielli | 482/63 |
| 5,954,621 | 9/1999 | Joutras et al. | 482/114 |

*Primary Examiner*—Glenn E. Richman
*Attorney, Agent, or Firm*—Wall Marjama & Bilinski

[57] ABSTRACT

A device for training and measuring the physical efforts of a user of a nonmotorized rolling vehicle arranged on a turning assembly capable of exerting a load moment imparts a cyclical braking moment which passes from a preestablished value to a zero value dependent on the speed of the vehicle. The braking moment is controlled by detection and measurement of the speed or acceleration of the vehicle in order to drive the vehicle at a constant or substantially constant speed.

7 Claims, 5 Drawing Sheets

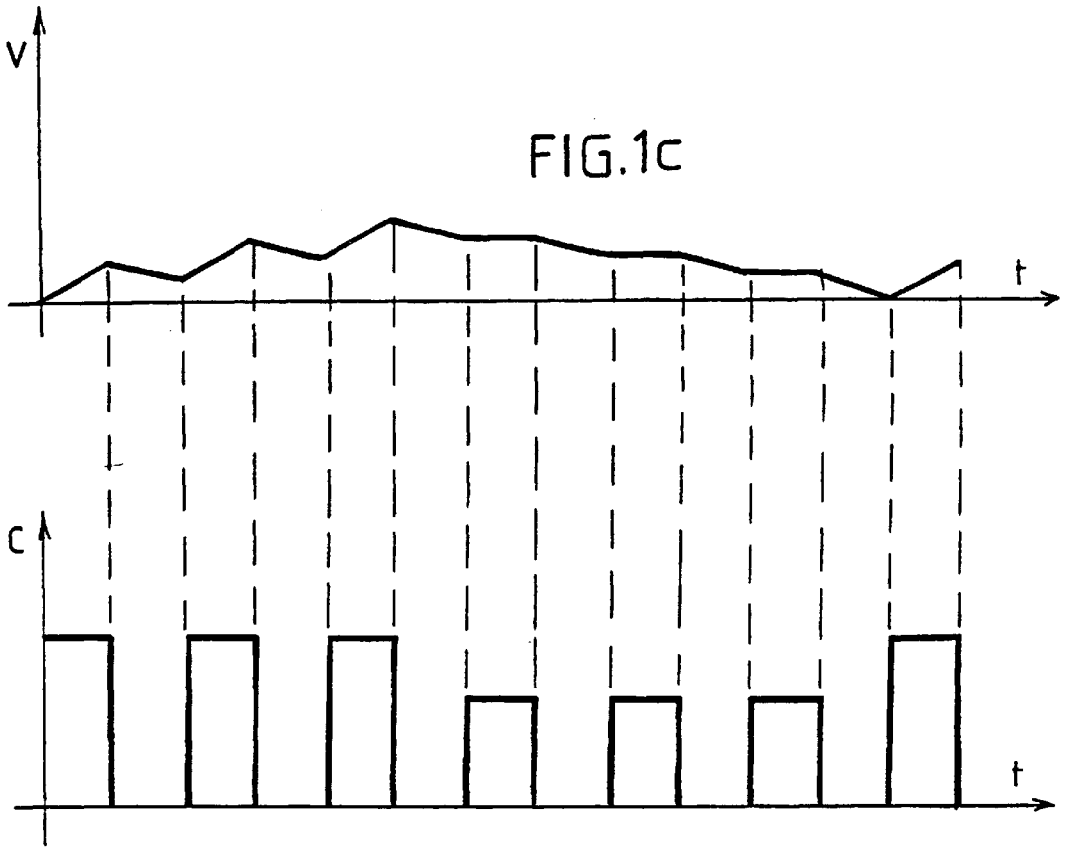
FIG.1c
FIG.1b
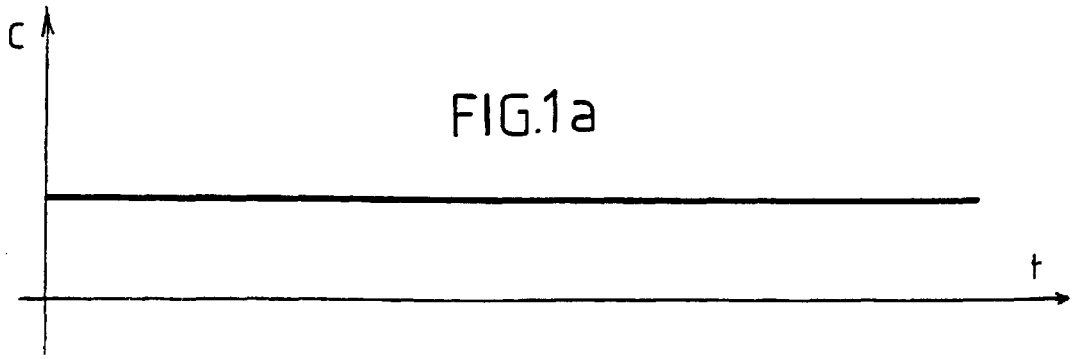
FIG.1a

VG
VC
t
C
CM
t

C
CF
t

V

γ
t
C
CM t
C
CF
t

V
RM
R1
R2
MV
MF
FM
ST
EA
AL
SA
L
MPV
MPA

METHOD FOR TRAINING AND FOR MEASURING PHYSICAL EFFORTS OF A PERSON IN A NON-MOTORIZED WHEEL VEHICLE

FIELD OF THE INVENTION

The invention relates to the technical sector of home-trainer-type apparatus for training individuals on bicycles or in wheelchairs.

BACKGROUND OF THE INVENTION

For the training, rehabilitation and measurement of various physical parameters it is known to use apparatus of the home-trainer type which are constructed so as to receive various types of nonmotorized rolling vehicles. For example, these home trainers or turning assemblies may receive a bicycle or a wheelchair. Essentially, such apparatus comprise at least two motorized rollers interacting either with the wheel of the bicycle driven by the user by means of a pedalling action or with the two wheels of the wheelchair driven directly by the user's arms.

In point of fact, it has become apparent that the moment imparted by the user who therefore drives a rotary system, namely the wheel or wheels of the vehicle, is not constant. In the case of a bicycle, the moment passes from a maximum value to a value which is practically zero when passing through dead center. In the case of a wheelchair, the moment imparted is variable when the subject pulls and pushes with his arms. This moment is completely zero throughout the phase during which the user takes his hands off the driven wheels in order to reposition them with a view to exerting further effort.

Particularly in the case of a wheelchair, if the movable assembly exerts a constant braking moment, the use of such a chair becomes very difficult or even practically impossible: during each of the nondrive phases, i.e. when the user is no longer exerting any moment, the speed of the vehicle decelerates and may even become zero. The result of this is that, during each drive phase, the user has to exert an acceleration force preventing him from achieving a comfortable operating speed.

The state of the art may be illustrated by the teaching of Patent DE-A-2950605, which relates to a drive apparatus for a bicycle, whose function is to cause the resistance of the drive unit to vary by means of a complementary wheel.

SUMMARY OF THE INVENTION

The object of the invention is to remedy these drawbacks simply, safely, efficiently and rationally.

The problem which the invention proposes to solve is to enable any user of a rolling vehicle of the bicycle or wheelchair type to work under optimum conditions, i.e. to impart the desired effort at a comfortable operating speed.

To solve such a problem, a device has been designed and developed for training and measuring the physical efforts of a person in a nonmotorized rolling vehicle arranged on a turning assembly and capable of exerting a load moment, which comprises means capable of imparting to the assembly a braking moment which, in a cyclical manner, passes from a preestablished value to a zero value is a function of parameters which depend on the speed of said vehicle in order to enable the person to drive the vehicle at a constant or substantially constant speed.

In a first embodiment, the means capable of imparting to the turning assembly a braking moment which, in a cyclical manner, passes from a preestablished value to a zero value, are controlled by means for measuring and detecting the speed of said vehicle with a view to imparting said moment only when a predetermined reference speed is exceeded.

Under these conditions, if the speed of the vehicle has not reached the reference speed, no braking moment is exerted on the turning assembly so that the deceleration is zero when the user is not exerting a drive torque. In this case, the subject will therefore naturally work around the predetermined reference speed which corresponds to any value.

In another embodiment, with a view to solving the problem posed, the means capable of imparting to the turning assembly a braking moment which is not constant are controlled by members for measuring and detecting the acceleration of the vehicle with a view to imparting said moment only when said assembly is driven, i.e. when it provides a positive acceleration.

Under these conditions, when the subject relaxes his effort, the acceleration is cancelled out while the braking moment becomes zero. The result of this is that the subject may choose to work at a speed which is comfortable for him, the power provided being very substantially equal to the braking power.

According to another characteristic, this device comprises means for measuring the power imparted by the person, incorporating the parameters relating to the actual speed, to the braking moment and to the accelerations of the masses in movement.

BRIEF DESCRIPTION OF THE DRAWINGS

The invention is described below in greater detail with the aid of the appended drawings, in which:

FIG. 1 shows the curves for speed and moment as a function of time, according to the state of the art:

Figures 2A, 2B, 2C:
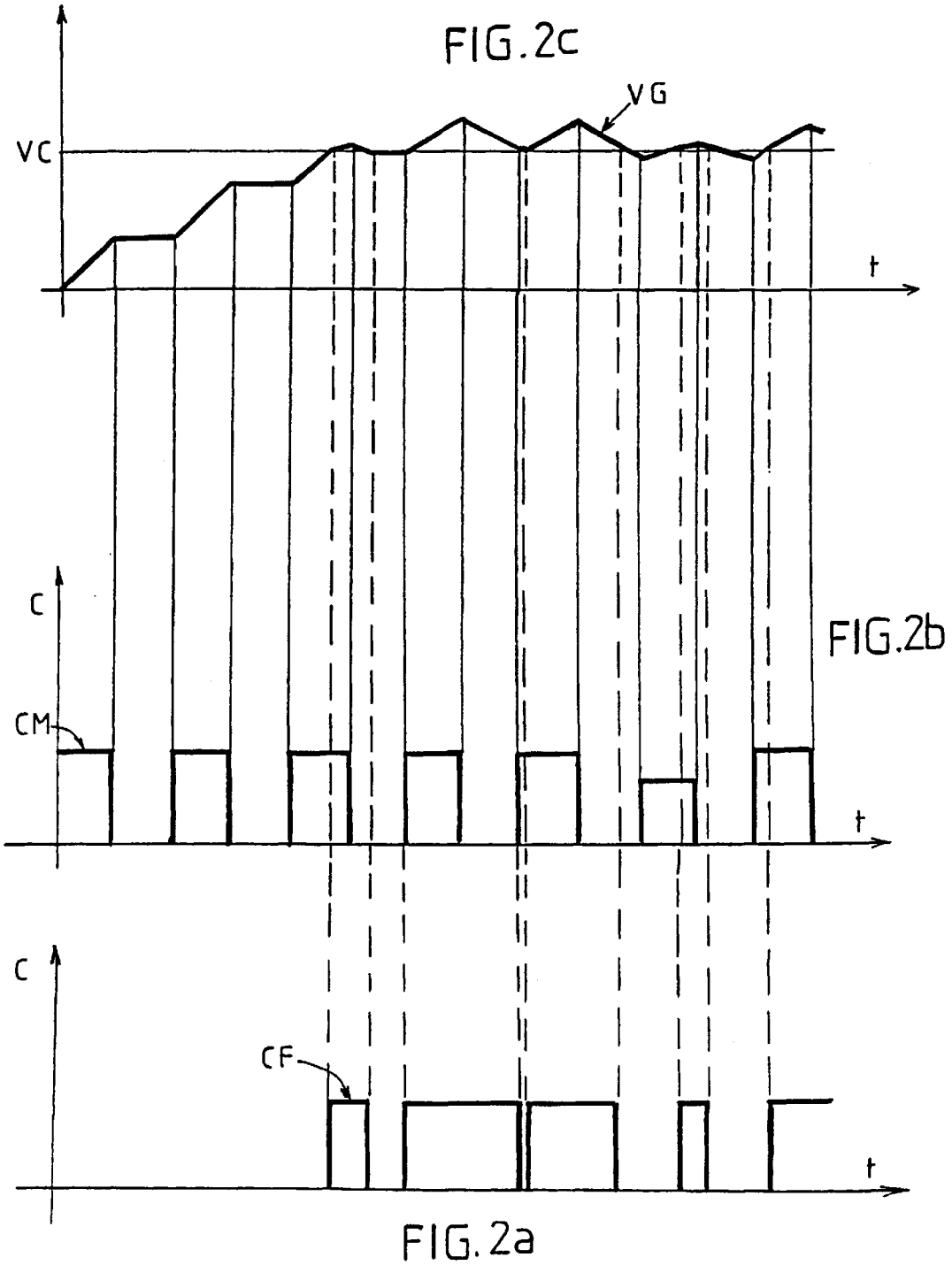
Figures 3A, 3B, 3C:
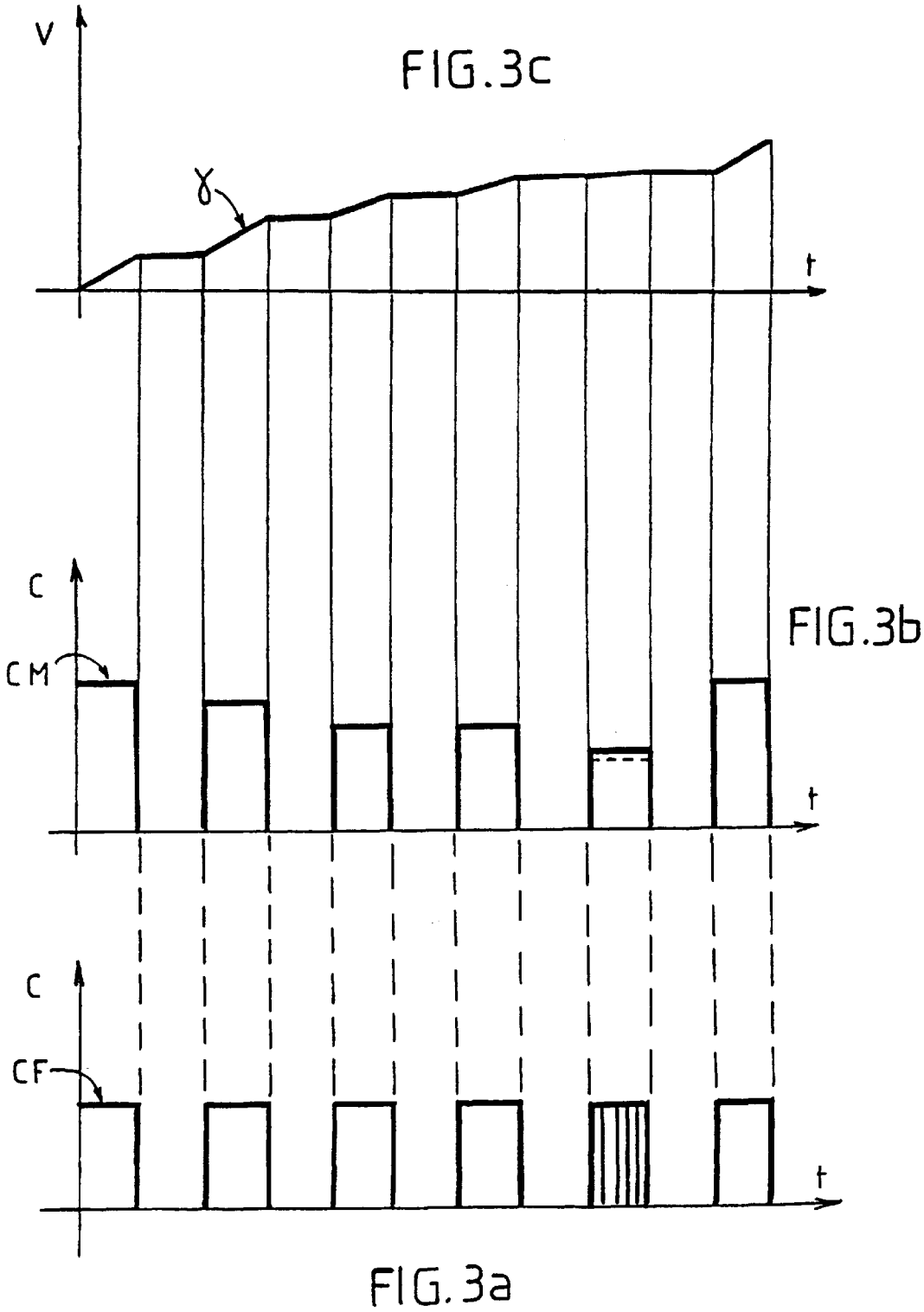
Figure 4:
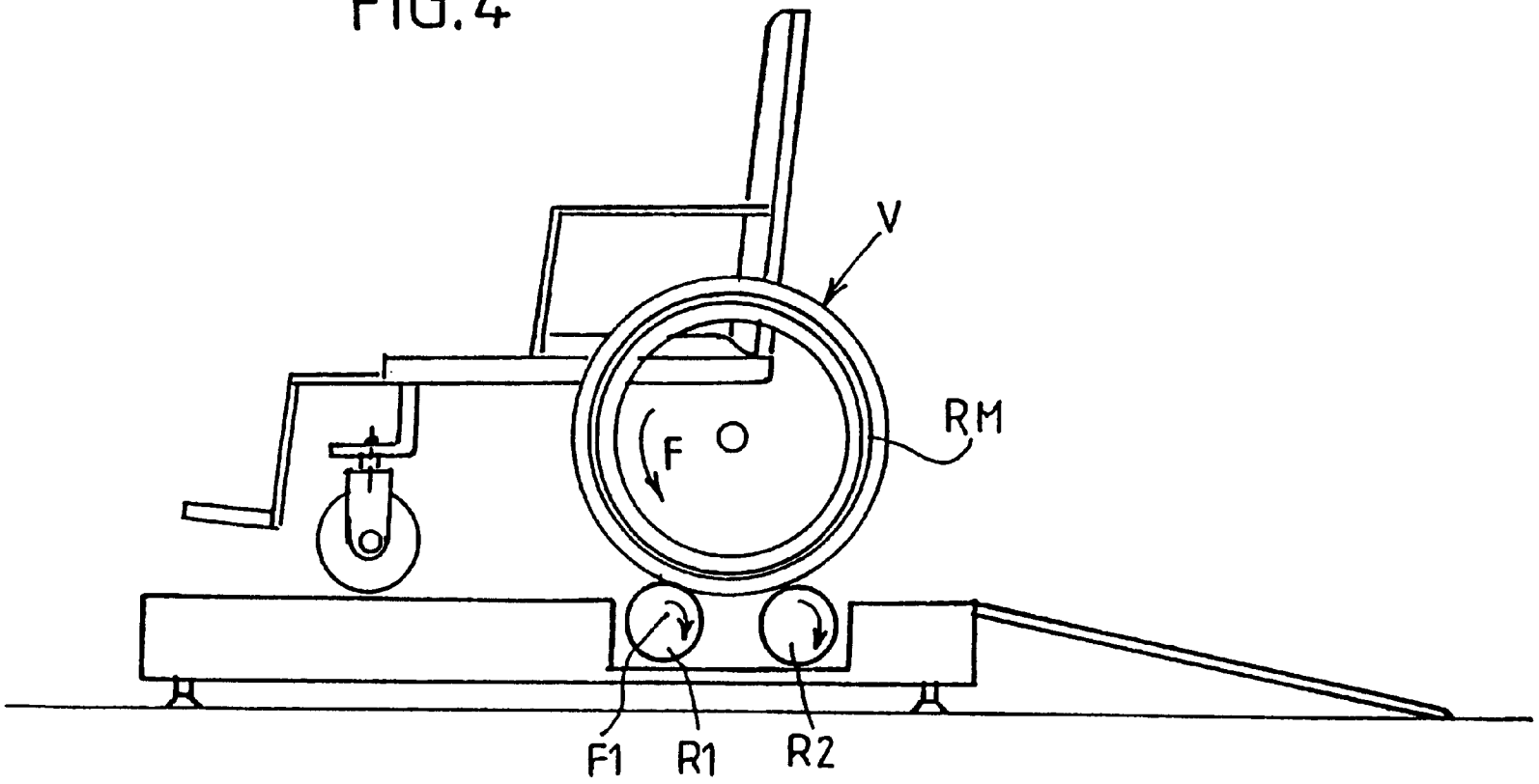
Figure 5:
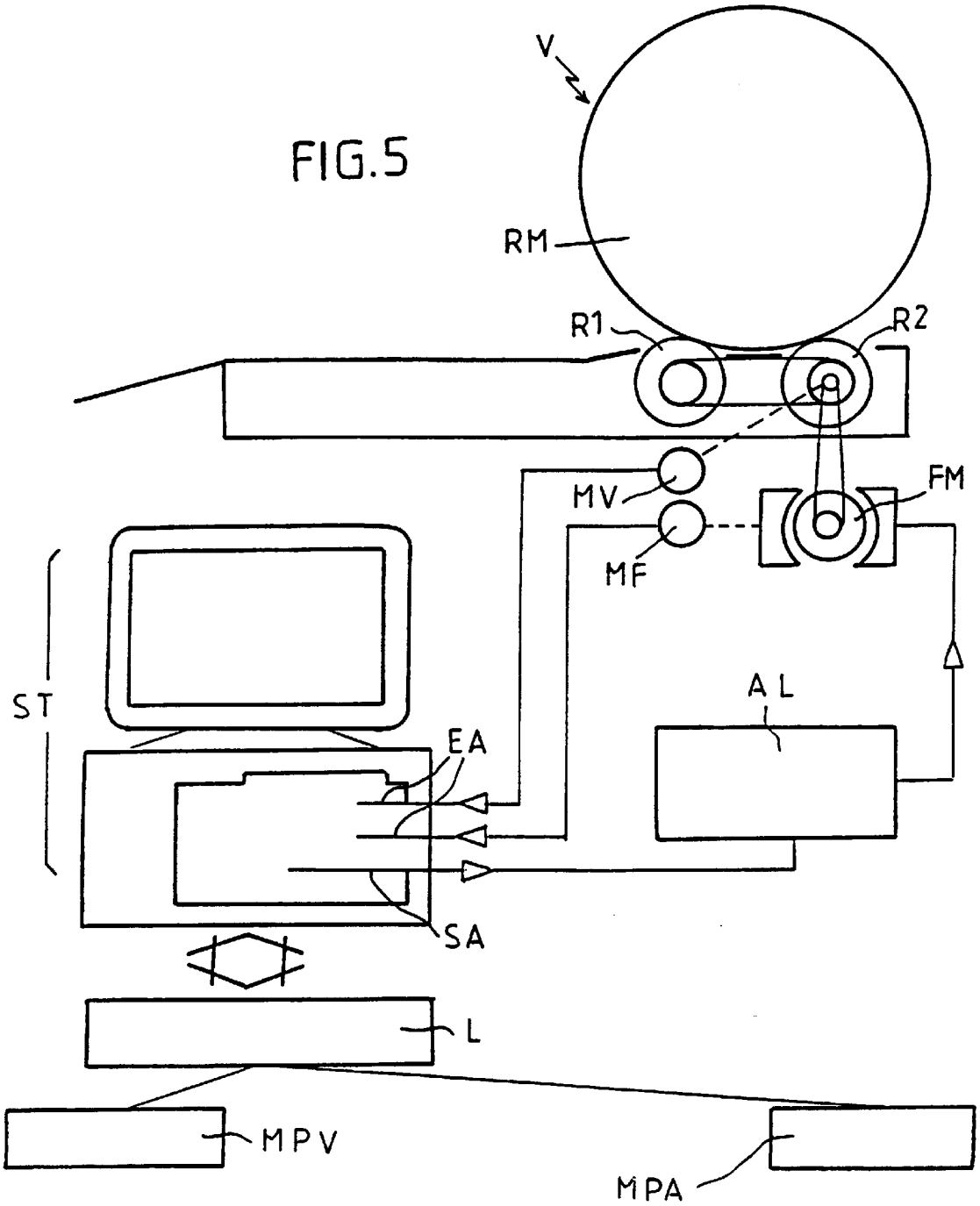

curve 1*a* corresponds to the braking moment exerted by the turning assembly;

curve 1*b* corresponds to a succession of drive torques provided by the subject;

curve 1*c* corresponds to the variations in speed noted particularly at the wheel or wheels of the rolling vehicle;

FIG. 2 is a view corresponding to FIG. 1 in the case where the braking moment (curve 2*a*) is exerted only when a preestablished reference speed is exceeded (curve 2*c*), curve 2*b* corresponding to the succession of drive torques imparted by the subject;

FIG. 3 is a view corresponding to FIG. 1 in the case where, according to the second technical solution of the invention, the braking moment (curve 3*a*) is exerted only when the subject accelerates the turning assembly (curve 3*c*). Curve 3*b* corresponds, as above, to the succession of drive torques imparted by the subject;

FIG. 4 is a diagrammatic view showing an illustrative application of the device according to the invention in the case of the use of a turning assembly adapted for a wheelchair;

FIG. 5 is a diagram showing the operating principle of the measuring device.

DETAILED DESCRIPTION OF THE INVENTION

Illustrated in FIG. 4, by way of indicative but nonlimiting example, is a turning assembly in the form of a home-trainer-type apparatus which has, in particular, two drive rollers (R1) and (R2) on which the wheel or wheels either of a bicycle or of a wheelchair bears or bear. The wheel or wheels bearing on the two rollers (R1, R2) which are arranged in two parallel planes are driven by the user in the direction of the arrow F by exerting a drive torque. The rollers (R1, R2) are retained by a force Fl in the opposite direction in order to create a braking load moment of variable and adjustable value. These provisions are not described in detail as they are completely familiar to a person skilled in the art.

According to the prior art of the technique, and as illustrated in FIG. 1, when the rollers (R1, R2) are subjected to a constant braking moment (CF) (curve 1*a*), the speed of the vehicle (V), particularly of the wheel (Rm), tends to decelerate until it becomes zero or substantially zero (curve 1*c*) since the drive torque exerted by the user is discontinuous (curve 1*b*).

According to an underlying characteristic of the invention, the rollers (R1, R2) are controlled by means capable of imparting to the assembly a braking moment (CF) which is no longer constant but which is a function of parameters which depend on the speed of the vehicle in order to allow the user to train at constant or substantially constant speed. In this connection, the device according to the invention essentially implements two technical embodiments which both use the same physical principle which consists in controlling the braking moment as a function of parameters linked to the speed.

According to the technical solution illustrated in FIG. 2, the braking moment (CF) (curve 2*a*) is applied only when the speed $\overrightarrow{(Ve)}$ of the vehicle (V), and thus of the turning assembly, exceeds a preestablished reference speed Vc (curve 2*c*).

Under these conditions, if the speed (Ve) has not reached the reference speed (Vc), the braking moment (CF) (curve 2*a*) is zero, as long as the subject does not exert a drive torque. When the subject exceeds the reference speed (Vc), the deceleration is equivalent to that illustrated in FIG. 1. The result of this is that the subject will naturally work about this reference speed (Vc), exerting a drive torque (Cm) as shown by curve 2*d*.

In the technical solution illustrated in FIG. 3, the braking moment (CF) (curve 3*a*) is applied only when the subject accelerates the turning assembly (E), i.e. when the subject exerts a drive torque, (γ) being the various accelerations (curve 3*c*). When the subject relaxes his effort, i.e. when he is no longer exerting a drive torque, the acceleration (γ) is cancelled out and the braking moment (CF) is cancelled out. As previously, the subject may choose to work at comfortable speeds, the power provided by the subject being equal to the braking power at this speed.

According to the embodiment, the device includes means for measuring the power imparted by the subject, incorporating the parameters relating to the actual speed, to the braking moment and to the acceleration of masses in movement.

As indicated, the device applies particularly advantageously to the training and measurement of the physical efforts of a person on a bicycle or in a wheelchair.

The various means for measuring and detecting, particularly, the speed of the rollers (R1, R2), are controlled by any electronic command system in order to subject said rollers to a braking moment under the conditions indicated, incorporating the parameters which are a function of the speed of the rolling vehicle (bicycle, wheelchair).

Reference is made, for example, to the diagram in FIG. 5 which shows an illustrative embodiment of control of the rollers (R1) and (R2) for measuring the speed and the force and for analyzing these values. In this diagram:

(FM) denotes an electromagnetic brake controlled by the system of rollers (R1) and (R2), while (AL) denotes a linear supply system for the brake;

(MV) denotes a means for measuring the speed;

(MF) denotes a means for measuring the force;

(ST) denotes a computer command and management system in which (L) corresponds to the software and (EA) to the analog input of measurement of the speed and of the force, (SA) representing an analog output for commanding the brake (FM) and (MPV) and (MPA) represent the methods of controlling the speed and the acceleration, respectively.

As indicated previously, in the case where the control method depends on the speed, if the value of the speed is greater than the value of the reference speed (Vc), the brake (FM) is actuated. Conversely, if the value of the speed is less than the reference speed (Vc), the brake (FM) is not actuated. In the case where the control method depends on the acceleration, if the latter is greater than or equal to 0, the brake (FM) is actuated, while, if this acceleration is negative, the brake is no longer actuated.

Without thereby departing from the scope of the invention, the device applies to any type of turning assembly which comprises at least one roller. In other words, it is not excluded that use should be made of an assembly comprising a single roller controlled by a braking system. The example illustrated in FIG. 4 is given purely for indicative purposes.

What is claimed is:

1. A device for training and measuring the physical efforts of a person using a nonmotorized rolling vehicle, said vehicle being arranged on a turning assembly capable of exerting a load moment, said device comprising:

means for imparting a variable braking moment to the turning assembly, said braking moment being cyclical and passing from a preestablished value to a zero value, said moment value being a function of parameters dependent on the speed of said vehicle in order to enable the user to drive the vehicle at a substantially constant speed.

2. The device as recited in claim 1, wherein said moment imparting means are controlled by means for detecting and measuring the speed of said vehicle, in which said moment imparting means impart a braking moment only when a predetermined vehicle speed is exceeded.

3. The device as recited in claim 1, wherein said moment imparting means are controlled by members capable of detecting and measuring the acceleration of said vehicle, in which said moment imparting means imparts a braking moment when a positive acceleration of said vehicle is detected.

4. The device as recited in claim 1, including means for measuring the power imparted by a user, said power measuring means incorporating parameters based on the actual speed of the vehicle, the value of the variable braking moment being applied, and the accelerations of the masses in motion.

5. The device as recited in claim 4, wherein the turning assembly includes at least one roller controlled by braking means which interacts with at least one wheel of a vehicle being driven in rotation by said user for braking said vehicle.

6. The device as recited in claim 1, wherein the vehicle is a bicycle.

7. The device as recited in claim 1, wherein the vehicle is a wheel chair.

* * * * *

UNITED STATES PATENT AND TRADEMARK OFFICE

CERTIFICATE OF CORRECTION

PATENT NO. : 6,142,911

DATED : November 7, 2000

INVENTOR(S) : Bernard Sauvignet et al.

It is certified that error appears in the above-identified patent and that said Letters Patent is hereby corrected as shown below:

[73]Assignee should read: Centre Stephanois de Recherches Mecaniques Hydromecanique et Frottement S.A., France Signed and Sealed this Fifteenth Day of May, 2001

*Attest:*

Nicholas P. Godici

NICHOLAS P. GODICI

*Attesting Officer*

*Acting Director of the United States Patent and Trademark Office*